United States Patent [19]

Gray

[11] 4,232,808

[45] Nov. 11, 1980

[54] INSTRUMENT PROTECTING AND CARRYING STRUCTURE

[76] Inventor: Roy M. Gray, P.O. Box 10508, Phoenix, Ariz. 85064

[21] Appl. No.: 82,889

[22] Filed: Oct. 9, 1979

[51] Int. Cl.[3] ..... F16B 39/24; A45C 11/08

[52] U.S. Cl. ..... 224/205; 224/908; 224/909; 150/52 J

[58] Field of Search ..... 224/205, 908, 909; 150/52 J; 354/288

[56] References Cited

U.S. PATENT DOCUMENTS

| | | | |
|---|---|---|---|
| 2,537,303 | 1/1951 | Cobb, Jr. et al. | 150/52 J |
| 4,071,066 | 1/1978 | Schaeffer | 150/52 J |
| 4,136,726 | 1/1979 | Lee | 150/52 J |
| 4,162,696 | 7/1979 | Sprung | 150/52 J |

*Primary Examiner*—Steven M. Pollard

*Attorney, Agent, or Firm*—Herbert E. Haynes, Jr.

[57] ABSTRACT

An elongated strap for looped positioning around a person's neck is provided with coupling devices on its ends for suspendingly carrying an instrument such as a camera, binoculars, and the like. A cover bag of flexible nonporous material is disposed in an inverted position with its closed bottom being affixed to the straps adjacent the coupling devices in a manner which places the coupling devices and the instrument carried thereby within the bag. The open end of the bag faces downwardly and is provided with means for closing the opening. In use, the bag is opened and pulled upwardly to turn it inside out and expose the instrument for use.

4 Claims, 4 Drawing Figures

INSTRUMENT PROTECTING AND CARRYING STRUCTURE

BACKGROUND OF THE INVENTION

1. Field of the Invention

This invention relates to instrument carrying and protection devices and more particularly to an improved structure by which an instrument is suspendingly carried in an inverted cover-bag which is turned to an inside out position to expose the instrument for use.

2. Description of the Prior Art

Portable instruments such as cameras, binoculars, sextants, telescopes and the like are often carried on a strap which is looped about a person's neck with the opposite ends of the strap having connectors which are coupled to the instrument. This carrying technique exposes the instrument to the elements such as dust and rain, and also exposes the instrument to physical damage such as bumping into objects and falling to the ground when one or the other of the strap connectors becomes decoupled from the instrument.

An improved portable instrument carrying technique includes the use of rigid, or semirigid, cases which house the instrument and are suspended by the same type of neck strap and have a suitable hinged lid for access and removel of the instrument. Such cases do protect the instruments from the elements and will cushion bumps occurring from swinging contact with objects. However, decoupling of one of the neck strap connectors will still allow the instrument to fall to the ground as a result of the strap sliding off of the person's neck. Further, such instrument carrying cases are expensive and in general are cumbersome to use.

For example, a typical carrying case for binoculars and cameras includes the above mentioned hinged lid so that when a person wants to use the instrument, the lid must be unsnapped and the instrument completely removed from its carrying case before it can be used. Due to object situation changes taking place during this rather time consuming instrument readying procedure, many desired action photographs and desired close-up views are missed.

In addition to this instrument readying procedure being a time consuming operation, it can, and often is a rather cumbersome task and many instruments have been dropped.

Therefore, a need exists for a new and improved instrument protecting and carrying structure which overcomes some of the problems and shortcomings of the prior art.

SUMMARY OF THE INVENTION

In accordance with the present invention, a new and improved instrument protection and carrying structure is disclosed as preferably including a strap for looped positioning around a person's neck so that the opposite ends of the strap are positioned in front of the person at approximately the mid-point of the torso. The ends of the strap each have a coupling means thereon for attachment to any portable instrument such as cameras, binoculars, sextants, telescopes and the like. Such a pendulously suspended instrument is protected from the elements by an inverted cover bag formed of any suitable material which is flexible and preferably water and dust proof. The inverted cover bag has its closed end affixed to the straps adjacent the ends thereof so that the strap cannot slide off of a person's neck and allow the instrument to fall upon decoupling of one of the strap's connector means. The coupling means and the instrument are enclosed within the inverted cover-bag and the open end thereof is disposed below the bottom of the instrument and is provided with means for closing the open end such as a draw string, zipper, snaps or the like.

To ready an instrument carried in the above described structure for use, the cover bag is opened and pulled up in a manner which turns it inside out, and this simple action exposes the instrument for use.

Accordingly, it is an object of the present invention to provide a new and improved instrument protecting and carrying structure.

Another object of the present invention is to provide a new and improved instrument protecting and carrying structure which is inexpensive to manufacture and simple to use.

Another object of the present invention is to provide a new and improved instrument protecting and carrying device which can be adapted to carry and protect any portable instrument of the type which may be carried by a strap looped about a person's neck.

Another object of the present invention is to provide a new and improved instrument protecting and carrying structure of the above described type which includes a neck strap from the ends of which an instrument is pendulously suspended and having an inverted flexible cover-bag affixed to the strap so as to inclose the instrument therein.

Another object of the present invenion is to provide a new and improved instrument protecting and carrying structure of the above described type in which the inverted flexible cover-bag has its open end disposed below the pendulously suspended instrument with that open end having means thereon for closing the opening.

Still another object of the present invention is to provide a structure of the above described character in which the flexible cover-bag is affixed to the ends of the strap in a manner so that by pulling the bag upwardly and turning it inside out the instrument will become exposed for use.

Yet another object of the present invention is to provide a structure of the above described type in which the flexible cover-bag is fabricated of a material which is water and dust proof to protect the instrument from rain, dust, and other elements.

The foregoing and other objects of the present invention, as well as the invention itself, may be more fully understood from the following description when read in conjunction with the accompanying drawings.

DESCRIPTION OF THE PREFERRED EMBODIMENT

Figure 1:
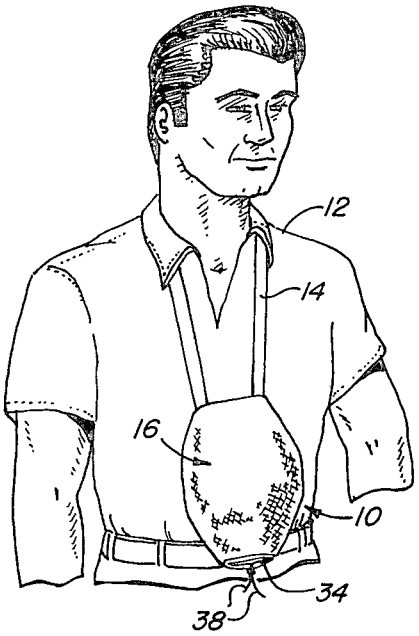
FIG. 1 is a prospective view of the instrument protecting and carrying structure of the present invention, with the structure being shown in the preferred carrying position on a person.

Referring more particularly to the drawings FIG. 1 illustrates the instrument protecting and carrying structure of the present invention which is indicated generally by the reference numeral 10. The structure 10 is designed to be preferably carried about the neck of a person 12 in the maner shown, and therefore, is provided with a neck strap 14 and has an instrument protecting bag 16 as will hereinafter be described in detail.

The strap 14 is an elongated member formed of any suitable material such as a woven fabric which is flexible so that it can be looped about th neck of the person 12. The length of the elongated strap 14 is suitably sized so that its opposite ends 18 and 20 will be disposed at approximately the midpoint of a person's torso when the strap is looped about the neck of the person 12.

Figure 2:
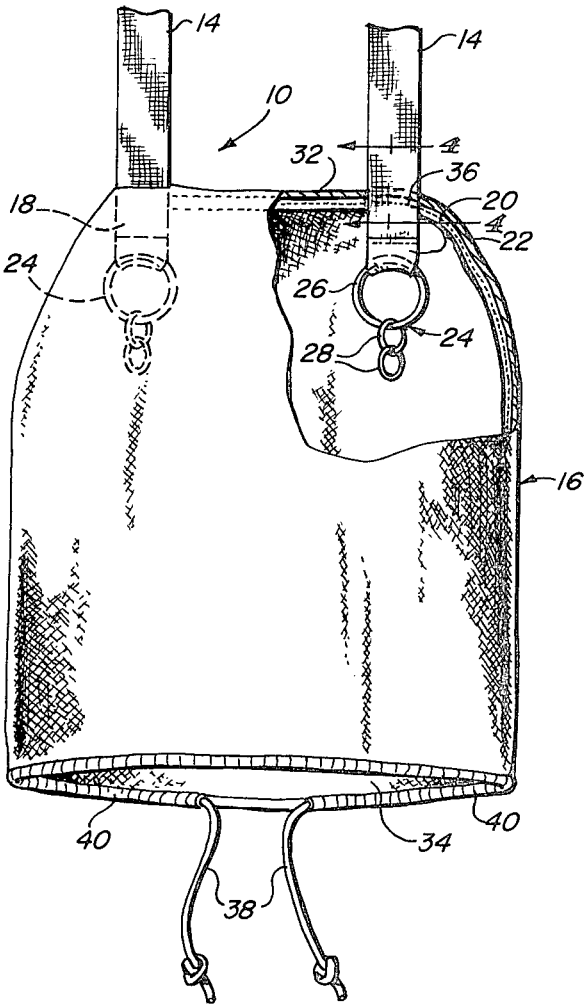
FIG. 2 is an enlarged fragmentary front elevational view of the structure of the present invention with a portion thereof being broken away to illustrate the various features thereof.

Each of the opposite ends 18 and 20 of the strap 14 are folded back on themselves as seen at 22 in FIG. 2, and stitched or otherwise fixed in that position to captively hold a coupling means 24.

The coupling means 24 may be any of several well known devices such as spring clips (not shown) or the like. In the embodiment best seen in FIG. 2, each of the coupling means 24 includes a closed loop 26 which is fixedly carried on its respective end 18 or 20, with a pair of split rings 28 depending therefrom in a chainlink fashion.

Figure 3:
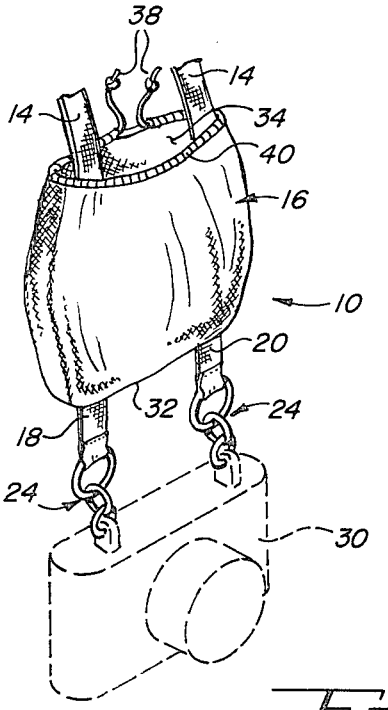
FIG. 3 is a fragmentary prospective view of the structure of the present invention showing the instrument covering bag thereof in the pulled-up inside-out position to expose the instrument carried by the structure.
Figure 4:
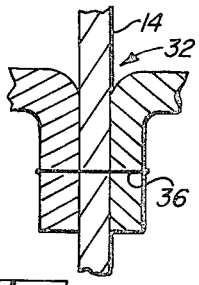
FIG. 4 is an enlarged fragmentary sectional view taken on the line 4—4 of FIG. 2.

In the event, the coupling means 24 are intended for attachment to an instrument such as a camera 30 shown in phantom lines in FIG. 3. It should be understood that the structure 10 of the present invention is intended to carry and protect any instrument which is suitable for carrying on the neck strap 14. Thus, in addition to the camera 30, the structure 10 may alternately carry binoculars, a sextant, a telescope, or any other such instrument. Since the structure 10 is not intended to carry one type of instrument only, it should be understood that the coupling means 24 may vary in accordance with the type of instrument to be carried, and in accordance with personal preference.

When the cover bag 16 is in the instrument protecting position, as seen best in FIG. 2, it is inverted in that its closed end 32 is upwardly disposed and its open end 34 faces downwardly. The opposite ends 18 and 20 of the neck strap 14 pass through the closed end 32 of the cover bag 16 at spaced apart locations, and the cover bag is suitably affixed to the strap 14 at points just above the coupling means 24 such as by stitches 36. Such affixation of the cover bag 16 to the opposite ends 18 and 20 of the strap 14, locates the coupling means 24 within the cover bag adjacent the upwardly disposed closed end 32 thereof so that when an instrument, such as the camera 30, is connected to the coupling means 24, the instrument will be disposed completely within the confines of the cover bag.

The open end 34 of the cover bag 16 is provided with means for closng the opening, such as a draw string 38 positioned in the conventional manner within the usual open ended draw string encasing tubing 40 which is stitched or otherwise formed about the periphery of the open end 34. The draw string 38 is the preferred form of the closing means, however, it should be understood that other well known closing devices could be employed, such as a zipper (not shown), snaps (not shown), velcro strips and the like.

The cover bag 16 may be fabricated of any suitable flexible material which, in addition to being flexible, is preferably a nonporous material which is waterproof and dustproof to protect the instrument contained therein from the elements such as rain, dust, and the like. Examples of material suitable for use in fabricating the cover bag 16 are for example, a suitable fabric base material which is coated, impregnated, or otherwise treated with a waterproofing agent, flexible polyvinyl chloride, and the like.

When the person carrying the structure 10 in the manner shown in FIG. 1 desires to use the instrument 30, he simply opens the downwardly facing open end 34 of the cover bag 16, by suitable operations of the closing means provided thereon, and pulls the cover bag upwardly in a manner which turns the bag inside out. This pulling up and turning inside out movement results in the cover bag 16 being moved to the position shown in FIG. 3 which exposes the instrument for use.

It will be noted that although the cover bag 30 must be of flexible material so that the above described instrument exposing movement can be accomplished, the material should not be limp, i.e., excessively flexible. This property is desirable so that when the bag is positioned as shown in FIG. 3, it will remain in that position and will thus free the person's hands and eliminate the need for some fastening means to hold the bag in the instrument exposing position.

While the principles of the invention have now been made clear in an illustrated embodiment, there will be immediately obvious to those skilled in the art, many modifications of structure, arrangements, proportions, the elements, materials, and components used in the practice of the invention, and otherwise, which are particularly adapted for specific environments and operation requirements without departing from those principles. The appended claims are therefore intended to cover and embrace any such modifications within the limits only of the true spirit and scope of the invention.

What I claim is:

1. An instrument protecting and carrying structure comprising:
   (a) an elongated strap of flexible material and having opposite ends;
   (b) a cover bag for containing an instrument, said cover bag of flexible material and disposed in an inverted position with a closed upwardly disposed end and an open downwardly facing end;
   (c) said strap having its opposite ends passing through the closed end of said cover bag at spaced apart locations with the opposite ends of said strap located within said cover bag adjacent the closed end thereof;
   (d) said cover bag attached to said strap at the points where the opposite ends pass through the closed end of said cover bag; and
   (e) coupling means on each of the ends of said strap for connection to the instrument containable in said cover bag.

2. An instrument protecting and carrying structure as claimed in claim 1 and further comprising closing means on the open downwardly facing end of said cover bag for selective opening and closing thereof.

3. An instrument protecting and carrying structure as claimed in claim 1 and further comprising a draw string carried in an open ended draw string encasing tubing formed about the periphery of the open downwardly facing end of said cover bag.

4. An instrument protecting and carrying structure as claimed in claim 1 wherein the material of said cover bag is waterproof and dustproof to protect the instrument carryable therein from the elements.

* * * * *